252-95 AU 166 Ex

9/5/78 XR 4,111,826

United States Patent [19]

Leigh et al.

[11] 4,111,826

[45] Sep. 5, 1978

[54] BLEACHING ASSISTANTS

[75] Inventors: Arthur George Leigh; Robin John Green, both of Merseyside, England

[73] Assignee: Lever Brothers Company, New York, N.Y.

[21] Appl. No.: 737,980

[22] Filed: Nov. 2, 1976

[30] Foreign Application Priority Data

Nov. 3, 1975 [GB] United Kingdom ..... 45661/75

[51] Int. Cl.[2] ..... C11D 7/22; C11D 10/02

[52] U.S. Cl. ..... 252/89 R; 252/94; 252/95; 252/99; 252/174; 427/212; 427/213

[58] Field of Search ..... 252/89, 94, 95, 99, 252/174; 427/212, 213

[56] References Cited

U.S. PATENT DOCUMENTS

| | | | |
|---|---|---|---|
| 2,992,186 | 7/1961 | Hellsten | 252/99 X |
| 3,163,606 | 12/1964 | Viveen et al. | 252/95 X |
| 3,779,931 | 12/1973 | Fries et al. | 252/99 |
| 4,003,841 | 1/1977 | Hachmann et al. | 252/94 |

*Primary Examiner*—Mayer Weinblatt

*Attorney, Agent, or Firm*—Kenneth F. Dusyn; James J. Farrell; Melvin H. Kurtz

[57] ABSTRACT

A bleaching assistant in the form of granulated particles for use in or with a washing and bleaching composition is provided which comprises:

(a) 50–85% by weight of a bleaching activator for percompounds selected from the group consisting of N-acyl and O-acyl compounds and carbonic acid esters;

(b) 2–25% by weight of a stabilizing agent for percompounds e.g. organic phosphonic acids or ethylenediaminetetraacetate;

(c) 7–30% by weight of a nonionic surface-active compound having a melting point of at least 35° C.

5 Claims, No Drawings

BLEACHING ASSISTANTS

The invention relates to bleaching assistants for use in or with washing and bleaching compositions and the preparation of said bleaching assistants.

Detergent compositions which contain so-called bleaching activators in addition to the usual detergent substances having a cleaning action, builders and bleaching percompounds, are known. These activators comprise carboxylic acid derivatives which react with the percompounds, e.g. sodium perborate, with the formation of peracids and therefore increase the bleaching action of the compositions or make it possible to effect bleaching at relatively low or moderate washing temperatures. It is also known to incorporate agents which stabilise percompounds in solutions in detergent bleach compositions. The term "percompounds" is used here to indicate those percompounds which liberate oxygen from their solutions, such as perborates, percarbonates, perphosphates, and persilicates. The stabilising agents known in the art comprise ethylenediaminetetraacetic acid and its alkali metal salts, and the organic phosphonic acids, such as ethane-1-hydroxy-1,1'-diphosphonic acid, amino-trimethylene phosphonic acid and ethylenediaminetetra-(methylene phosphonic acid). In preparing detergent powder compositions by the spray-drying technique these stabilising agents are normally incorporated in the alkaline detergent slurry without difficulty. These stabilising agents, though being present in relatively small proportions, are an important ingredient in such washing compositions, since apart from reducing chemical damage to textiles, they inhibit the deleterious side reaction which occurs in the wash solution between the peracid formed and the percompound to form non-bleaching products, which would result in a loss of bleaching efficiency.

Whilst on the one hand the storage properties of washing compositions comprising a bleaching activator and a bleaching percompound can be improved by providing the powder particles of the bleaching activator with an inert protective coating or by forming activator-containing particles from e.g. spray-cooling a molten mixture of the activator and a suitable carrier material, and on the other hand the slurry incorporation of stabilising agents for percompounds does not cause difficulties in preparing a percompound containing detergent bleach composition without an activator, the preparation and storage of washing compositions comprising a bleaching activator, a bleaching percompound and a percompound stabilising agent still pose considerable problems. It has been established that when the stabilising agent is incorporated in the alkaline detergent slurry before spray-drying, it loses its activity quite rapidly in a detergent bleach powder composition comprising an organic bleaching activator.

Apparently the stabilising agent not inactivated in the alkaline solution and during spray-drying is converted into a form which is quite sensitive to oxidation by the percompound or percompound/activator combination present in the formulation. Whilst simple post-dosing of the powdered stabilising agent to the spray-dried powder may mitigate said problem to only a certain extent, said measure will also give some practical problems, since relatively small proportions of stabilising agent as required in the washing composition give handling and dosing difficulties, requiring quite accurate dosing equipments. Besides, differences in powder dimensions and bulk density will give rise to undesirable segregation in the pack.

It is therefore an object of this invention to provide a useful adjunct which obviates the above difficulties.

The present invention therefore allows bleaching activators and bleaching percompounds to be used in conjunction with stabilising agents in detergent bleach compositions with greater efficiency than in manners hitherto known.

According to the invention, bleaching assistants are provided which can be used for post addition to particulate detergent and bleaching compositions or for addition to washing solutions comprising a peroxide bleach detergent composition.

The bleaching assistant according to the invention comprises granulated particles having a diameter of from about 0.2 mm to about 3.0 mm, and comprises as follows:

(a) 50 to 85%, preferably 60–75%, by weight of at least one bleaching activator for percompounds, selected from the group consisting of N-acyl and O-acyl compounds and carbonic acid esters, having a titre in the peracid formation test as described below of at least 1.5 ml. 0.1 N sodium thiosulphate;

(b) 2–25%, preferably 5–20%, by weight of at least one stabilising agent for percompounds;

(c) 7–30%, preferably 10–25%, by weight of a non-ionic surface-active compound having a melting point of at least 35° C.

The peracid formation test is a wellknown test method for selecting suitable bleaching activators. It has been described in U.S. Patent Specification No. 3,177,148 and is as follows:

Peracid formation test

A test solution is prepared by dissolving the following materials in 1000 ml. distilled water:

Sodium pyrophosphate $Na_4P_2O_7 . 10H_2O$ — 2.5 g.

Sodium perborate $NaBO_2.H_2O_2 . 3H_2O$ (having 10.4% available oxygen) — 0.615 g.

Sodium dodecylbenzene sulphonate (the dodecyl group being that derived from tetrapropylene. 0.5 g.

To this solution at 60° C. is added an amount of activator such that for each atom of available oxygen present one molecule of activator is introduced.

The mixture obtained by addition of the activator is vigorously stirred and maintained at 60° C. After 5 minutes from the addition a 100 ml. portion of the solution is withdrawn and immediately pipetted on to a mixture of 250 g. cracked ice and 15 ml. glacial acetic acid. Potassium iodide (0.4 g.) is then added and the liberated iodine is immediately titrated with 0.1 N sodium thiosulphate with starch as indicator until the first disappearance of the blue colour. The amount of sodium thiosulphate solution used in ml. is the titre of the bleaching activator.

It has been found that in particles as formulated above both the bleaching activator and the stabilising agent retain their activity during storage to a satisfactory extent. When the particles are mixed with percompound bleaching agents and particulate washing compositions they give sufficient protection against undesirable interaction between reactive and sensitive components.

The bleaching assistants according to the invention are preferably present in admixture with further particulate bleaching agent components, particularly inorganic percompounds, such as sodium perborate, sodium percarbonate and sodium perpyrophosphate, which in aqueous solution liberate hydrogen peroxide. In such mixtures a suitable proportion by weight of the bleaching assistant to the percompound will be from 3:1 to 1:7.

The bleaching assistants may also be present alone and added to washing and bleaching compositions comprising a percompound bleaching agent in the same proportional ratio at the time of use to enhance their bleaching action.

Suitable activators according to the invention include (a) N-diacylated and N.N'-tetraacylated amines, such as N,N,N',N'-tetraacetylmethylenediamine and -ethylenediamine, N,N-diacetylaniline and N,N-diacetyl-p-toluidine, and 1,3-diacylated hydantoins such as, for example, 1,3-diacetyl-5,5-dimethylhydantoin and 1,3-dipropionylhydantoin;

(b) N-alkyl-N-sulphonylcarbonamides, for example the compounds N-methyl-N-mesyl-acetamide, N-methyl-N-mesyl-benzamide, N-methyl-N-mesyl-p-nitrobenzamide, and N-methyl-N-mesyl-p-methoxybenzamide;

(c) N-acylated cyclic hydrazides, acylated triazoles or urazoles, for example monoacetylmaleic acid hydrazide;

(d) O,N,N-trisubstituted hydroxylamines, such as O-benzoyl-N,N-succinylhydroxylamine, O-acetyl-N,N-succinylhydroxylamine, O-p-methoxybenzoyl-N,N-succinyl-hydroxylamine, O-p-nitrobenzoyl-N,N-succinyl-hydroxylamine and O,N,N-triacetylhydroxylamine;

(e) N,N'-diacyl-sulphurylamides, for example N,N'-dimethyl-N,N'-diacetyl-sulphurylamide and N,N'-diethyl-N,N'-dipropionylsulphurylamide;

(f) Triacylcyanurates, for example triacetylcyanurate and tribenzoylcyanurate;

(g) Carboxylic acid anhydrides, such as benzoic anhydride, m-chlorobenzoic anhydride, phthalic anhydride, 4-chlorophthalic anhydride;

(h) Sugar esters, for example glucose pentaacetate;

(i) 1,3-diacyl-4,5-diacyloxy-imidazolidine, for example 1,3-diformyl-4,5-diacetoxy-imidazolidine, 1,3-diacetyl-4,5-diacetoxy-imidazolidine, 1,3-diacetyl-4,5-dipropionyloxy-imidazolidine;

(j) Tetraacetylglycoluril and tetrapropionylglycoluril;

(k) Diacylated 2,5-diketopiperazine, such as 1,4-diacetyl-2,5-diketopiperazine, 1,4-dipropionyl-2,5-diketopiperazine and 1,4-dipropionyl-3,6-dimethyl-2,5-diketopiperazine;

(l) Acylation products of propylenediurea or 2,2-dimethylpropylenediurea (2,4,6,8-tetraaza-bicyclo-(3,3,1)-nonane-3,7-dione or its 9,9-dimethyl derivative), especially the tetraacetyl- or the tetrapropionylpropylenediurea or their dimethyl derivatives;

(m) Carbonic acid esters, for example the sodium salts of p-(ethoxycarbonyloxy)-benzoic acid and p-(propoxycarbonyloxy)-benzenesulphonic acid.

The N-diacylated and N.N'-tetraacylated amines mentioned under (a) are of special interest, of which N,N,N',N'-tetraacetylethylenediamine (TAED) is particularly preferred.

Suitable stabilising agents for use in the invention include ethane-1-hydroxy-1,1-diphosphonic acid — (EHDP); amino-N-alkylidene phosphonic acids, for example aminotri-(methylene phosphonic acid) — (ATMP), and ethylenediamine tetra-(methylene phosphonic acid) — (EDTMP), and ethylenediaminetetraacetic acid — (EDTA) or its alkali metal salts.

A preferred stabilising agent according to the invention is ethylenediaminetetra-(methylene phosphonic acid).

Examples of nonionic surface-active compounds which may be used in the bleaching assistant of the invention are the water-soluble polyalkylene oxide e.g. polyethylene oxide and/or polypropylene oxide adducts of natural or synthetic, primary or secondary alcohols, fatty acids, fatty amides and alkyl phenols, having 5–25 ethylene oxide groups in the molecule and 8–22 carbon atoms in the hydrophobic moiety; and the polyethylene oxide adducts of polypropyleneglycol containing 20–300 ethyleneglycolether groups and 10 to 100 propyleneglycolether groups. Advantageously these nonionic surface-active compounds should have a melting point of at least 35° C., preferably between 40° C. and 50° C.

The bleaching assistant particles of the invention may be obtained by spraying a molten nonionic surface-active compound on to a moving bed of a mechanical mixture of the bleaching activator and the stabilising agent in the appropriate ratio. The temperature of the molten nonionic before spraying should preferably be kept at least 10° C. above the melting point.

A suitable equipment for use in the process for preparing the bleaching assistants according to the invention is a continuously operating pan granulator in which the powdered mixture of bleaching activator and stabilising agent is charged on to a slanting rotating plate or pan to form a moving bed, on to which the liquefied nonionic compound is sprayed. Finished granulated particles are discharged at the lower side of the slanting plate after passsing a weir.

The particles obtained are generally such that after a single sieving they are of suitable grain size to be used. The fines passing the screen can be recycled for use in the next granulating step. Oversize particles can be broken in a suitable apparatus and resifted.

The bleaching assistant particles of the invention are marked by a very regular grain size, good free-flowing properties, and a satisfactory solubility giving the right release pattern, especially when using a nonionic surfactant of a melting point of about 40° C. as a carrier, a very high stability on storage, and an appearance that is not discernible from spray-dried detergent composition beads.

The bleaching assistants of the invention may be present alone, in admixture with percompounds, or mixed with any known particulate detergent compositions with or without bleaching agents. The term "particulate" includes e.g. granulates, extrudates, powder and beads. The size range of the bleaching assistant particles is selected so that they will not segregate in the base detergent composition of normal particle size.

Detergent compositions wherein the bleaching assistants may be incorporated generally comprise, apart from the bleaching percompound, at least one detergent-active material, and detergency builders. Further, alkaline components, fillers, and the usual adjuncts, such as optical brighteners, soil suspending agents, sequestering agents, perfume, colouring agents, etc. may be present. Also enzymes, particularly proteolytic enzymes, may be incorporated in the composition as desired.

The detergent active present in the composition may be a single active or a mixture of actives. The actives may be selected from the group of anionic, nonionic, amphoteric and zwitterionic detergent compounds and mixtures thereof. Examples of anionic detergent compounds are alkylaryl sulphonates (e.g. sodium dodecylbenzenesulphonate); products of the sulphonation of olefins, so-called olefinsulphonates; fatty alcohol sulphates; alkylether sulphates, in the form of their alkali metal salts, and alkali metal salts of longchain $C_8$–$C_{22}$ fatty acids.

Nonionic detergent compounds can be broadly defined as compounds produced by the condensation of alkylene oxide groups with an organic hydrophobic compound which may be aliphatic or alkylaromatic in nature. The length of the polyalkylene oxide group which is condensed with any particular hydrophobic group can be readily adjusted to yield a water-soluble compound having the desired degree of balance between hydrophilic and hydrophobic elements. Examples of suitable nonionic detergent compounds are the condensation products of $C_6$–$C_{12}$ alkylphenols with 5–25 moles of ethylene oxide per mole of alkylphenol; the water-soluble condensation products of $C_8$–$C_{22}$ aliphatic alcohols, either straight or branched chained, with 5–30 moles of ethylene oxide per mole of alcohol.

Amphoteric detergents include derivatives of aliphatic or aliphatic derivatives of heterocyclic secondary or tertiary amines in which the aliphatic moiety can be straight-chain or branched and wherein one of the aliphatic substituents contains from 8 to 18 carbon atoms and at least one aliphatic substituent contains an anionic water-solubilizing group.

Zwitterionic detergents include derivatives of aliphatic quaternary ammonium, phosphonium and sulphonium compounds in which the aliphatic moieties can be straight-chain or branched, and wherein one of the aliphatic substituents contains from 8 to 18 carbon atoms and one contains an anionic water-solubilizing group.

Other detergent-active materials are described in the books "Surface-Active Agents and Detergents" Vol. I and II by Schwartz, Perry and Berch (published by Interscience).

Examples of detergency builders are sodium and potassium triphosphate, sodium orthophosphate, sodium and potassium pyrophosphate, sodium carbonate; and organic nonphosphate builders such as nitrilotriacetic acid and its water-soluble salts, sodium ethylenediaminetetraacetate, carboxymethyloxymalonate, and carboxymethyloxysuccinate.

EXAMPLE I

A mixture of 72 parts of powdered N,N,N',N'-tetraacetylethylenediamine (=TAED) and 10 parts of ethylenediamine tetra-(methylene phosphonic acid) (=EDTMP) powder was charged at a rate of 300 kg/hour on to an Eirich pan granulator having a rotating plate of 100 cm. diameter. Liquefied nonionic (tallow alcohol condensed with 18 ethylene oxide) at a temperature of 80° C. was sprayed via a nozzle of 1.0 mm. diamter on to the moving powder bed at a rate of 66 kg/hr.

The granulated material discharged from the pan is collected and sieved through a screen having a mesh size of 1.68 mm. to remove oversize material and through a 0.3 mm. mesh size screen to remove fines.

The bleaching assistant granules retained between the screens were quite free-flowing, had an average diameter of 0.7 mm and were composed of about:

72% by weight of TAED,
10% by weight of EDTMP, and
18% by weight of nonionic material.

EXAMPLE II

The following example describes the storage behaviour of ethylenediaminetetraacetate (EDTA), a stabilising agent customarily included in spray-dried perborated powders, and of ethylenediaminetetra-(methylenephosphonic acid) — (EDTMP) incorporated either in the bleaching assistant or in the spray-dried slurry.

Four detergent bleach powder compositions were prepared:

| | Parts by weight | | | |
|---|---|---|---|---|
| | A | B | C | D |
| Na-dodecylbenzenesulphonate | 6.0 | 6.0 | 6.0 | 6.0 |
| Tallow amide/11 ethylene oxide | 4.5 | 4.5 | 4.5 | 4.5 |
| Sodium tripolyphosphate | 34.0 | 34.0 | 34.0 | 34.0 |
| Sodium carboxymethylcellulose | 0.8 | 0.8 | 0.8 | 0.8 |
| Sodium silicate | 4.0 | 4.0 | 4.0 | 4.0 |
| Sodium sulphate | 22.4 | 22.8 | 22.6 | 22.6 |
| EDTA (incorporated in slurry) | 0.2 | — | — | — |
| EDTMP (incorporated in slurry) | — | 0.5 | — | 0.5 |
| Moisture | 10.0 | 10.0 | 10.0 | 10.0 |
| TAED (Activator) granules [1] | — | 4.2 | — | — |
| Activator/stabiliser granules [2] | 4.9 | — | 4.9 | 4.4 |
| Coated sodium perborate tetrahydrate [3] | 11.8 | 11.8 | 11.8 | 11.8 |

1) TAED (Activator) granules prepared in similar manner as described in Example 1.
Composition: 87.2% by weight TAED
1.2% by weight of citric acid
11.6% by weight tallow alcohol/18 ethylene oxide.

2) Activator/stabiliser granules prepared in the manner as described in Example 1.
Composition of granules used in powders A and C.
72.0% by weight of TAED
10.0% by weight of EDTMP
18.0% by weight tallow alcohol/18 ethylene oxide.
Composition of granules used in powder D.
75.0% by weight of TAED
5.0% by weight of EDTA
20.0% by weight tallow alcohol/18 ethylene oxide.

3) Coated sodium perborate composition:
90 % by weight Na-perborate tetrahydrate
10 % by weight tallow alcohol/18 ethylene oxide.

The residual activities of stabilising agents after storage for 1, 2, 3 and 4 weeks under various climatic conditions are given below:

TABLE

| Powder | Climatic condition | % EDTA remaining after weeks | | | | % EDTMP remaining after weeks | | | |
|---|---|---|---|---|---|---|---|---|---|
| | | 1 | 2 | 3 | 4 | 1 | 2 | 3 | 4 |
| A | ambient | 100 | 100 | 85 | 100 | 78 | 74 | 92 | 94 |
| | 28° C/70% RH | 100 | 70 | 41 | 31 | 94 | 72 | 74 | 54 |
| | 37° C/70% RH | 23 | 11 | 13 | 18 | 88 | 76 | 46 | 56 |
| B | ambient | | — | | | 74 | 62 | 54 | 64 |
| | 28° C/70% RH | | — | | | 38 | 14 | 13 | 12 |
| | 37° C/70% RH | | — | | | 17 | 7 | 6 | 8 |
| C | ambient | | — | | | 66 | — | 70 | — |
| | 28° C/70% RH | | — | | | 64 | — | 92 | — |
| | 37° C/70% RH | | — | | | 62 | — | 72 | — |
| | ambient | 100 | 90 | 100 | 90 | 60 | 68 | 38 | 52 |

TABLE-continued

| Powder | Climatic condition | % EDTA remaining after weeks | | | | % EDTMP remaining after weeks | | | |
|---|---|---|---|---|---|---|---|---|---|
| | | 1 | 2 | 3 | 4 | 1 | 2 | 3 | 4 |
| D | 28° C/70% RH | 100 | 70 | 70 | 65 | 32 | 12 | nil | nil |
| | 37° C/70% RH | 70 | 40 | 40 | 41 | 4 | nil | nil | nil |

The above results clearly show that the bleaching assistants of the invention provide for an improved stability of EDTMP and EDTA.

EXAMPLES III–IV

Two more batches of bleaching assistant granules were prepared using the method of Example I, the composition of which was as follows:

| | III % by weight | IV % by weight |
|---|---|---|
| N,N,N',N',-tetraacetylethylene-diamine (TAED) | 73 | 75 |
| EDTMP | 10 | 7 |
| Tallow alcohol/18 ethylene oxide | 17 | 18 |

These granules had an average diameter of about 0.7 mm., were quite free-flowing and showed no substantial loss of EDTMP during storage.

We claim:

1. A bleaching assistant in the form of co-granulated particles having a diameter of from 0.2 mm to 3.0 mm for use in or with washing and bleaching compositions, consisting essentially of:

(a) 50 to 85% by weight of at least one bleaching activator for percompounds, having a titre in a peracid formation test of at least 1.5 ml 0.1N sodium thiosulphate, selected from the group consisting of:
(i) N-diacylated and N,N'-tetraacylated amines;
(ii) N-alkyl-N-sulphonyl carbonamides;
(iii) N-acylated cyclic hydrazides;
(iv) O,N,N-trisubstituted hydroxylamines;
(v) N,N'-diacyl-sufphurylamides;
(vi) Triacyl cyanurates;
(vii) Carboxylic acid anhydrides;
(viii) Sugar esters;
(ix) 1,3-Diacyl-4,5-diacyloxy-imidazolidine;
(x) Tetraacetyl glycoluryl and tetrapropionyl-glycoluril;
(xi) Diacylated 2,5-diketopiperazines;
(xii) Acylation products of propylene diurea; and
(xiii) Carbonic acid esters;

(b) 2 to 25% by weight of at least one stabilizing agent for percompounds selected from the group consisting of:
(i) ethane-1-hydroxy-1,1-diphosphonic acid, and its alkalimetal salts;
(ii) aminotri-(methylene phosphonic acid) and its alkalimetal salts;
(iii) ethylene diamine-tetra-(methylene phosphonic acid) or its alkalimetal salts; and
(iv) ethylene diamine-tetraacetic acid or its alkalimetal salts; and (c) 7 to 30% by weight of a nonionic surface-active compound selected from the group consisting of water-soluble polyalkylene oxide adducts of natural or synthetic, primary or secondary alcohols; polyalkylene oxide adducts of fatty acids, polyalkylene oxide adducts of fatty amides; polyalkylene oxide adducts of alkylphenols, each having 5–25 ethylene oxide groups in the molecule and 8–22 carbon atoms in the hydrophobic moiety; and polyethylene oxide adducts of polypropylene glycol containing 20 to 300 ethylene glycol ether groups and 10 to 100 propyleneglycolether groups; said nonionic compound having a melting point of at least 35° C.

2. Bleaching assistant according to claim 1, wherein the stabilising agent is ethylenediaminetetra-(methylenephosphonic acid).

3. Bleaching assistant according to claim 1, wherein component (a) is 60–75% by weight; component (b) is 5–20% by weight; and component (c) is 10–25% by weight.

4. Bleaching assistant according to claim 1, wherein the bleaching activator is N,N,N',N'-tetraacetylethylenediamine.

5. The bleaching assistant according to claim 1, wherein the nonionic surface-active compound has a melting point between 40° and 50° C.

* * * * *